US010858128B2

(12) United States Patent
Taylor

(10) Patent No.: US 10,858,128 B2
(45) Date of Patent: Dec. 8, 2020

(54) PACKAGING ASSEMBLY

(71) Applicant: TNA Australia Pty Limited, Lidcombe (AU)

(72) Inventor: Alfred Alexander Taylor, Lugarno (AU)

(73) Assignee: TNA Australia Pty Limtied, Lidcombe (AU)

( * ) Notice: Subject to any disclaimer, the term of this patent is extended or adjusted under 35 U.S.C. 154(b) by 189 days.

(21) Appl. No.: 15/676,822

(22) Filed: Aug. 14, 2017

(65) Prior Publication Data

US 2018/0072439 A1 Mar. 15, 2018

(30) Foreign Application Priority Data

Aug. 15, 2016 (AU) ..... 2016903211

(51) Int. Cl.

| | |
|---|---|
| ***B65B 9/22*** | (2006.01) |
| ***B65B 37/18*** | (2006.01) |
| ***B65B 37/02*** | (2006.01) |
| ***B65B 51/30*** | (2006.01) |
| ***B65B 9/20*** | (2012.01) |

(52) U.S. Cl.

CPC ..... *B65B 9/22* (2013.01); *B65B 9/2028* (2013.01); *B65B 37/02* (2013.01); *B65B 37/18* (2013.01); *B65B 51/30* (2013.01); *B65B 51/306* (2013.01)

(58) Field of Classification Search

CPC B65B 9/22; B65B 37/02; B65B 37/18; B65B 51/30; B65B 51/306; B65B 9/2028

USPC ..... 53/548, 550–552, 563

See application file for complete search history.

(56) References Cited

U.S. PATENT DOCUMENTS

| | | | |
|---|---|---|---|
| 4,043,098 | A | 8/1977 | Putnam, Jr. et al. |
| 4,118,913 | A | 10/1978 | Putnam, Jr. et al. |
| 4,136,505 | A | 1/1979 | Putnam, Jr. et al. |
| 4,663,917 | A | 5/1987 | Taylor et al. |
| 4,753,336 | A | 6/1988 | Taylor et al. |
| 4,910,943 | A | 3/1990 | Taylor et al. |
| 5,622,032 | A | 4/1997 | Ryan |
| 6,655,110 | B2 | 12/2003 | Taylor |
| 7,124,559 | B2 | 10/2006 | Taylor |

(Continued)

FOREIGN PATENT DOCUMENTS

| | | | |
|---|---|---|---|
| AU | 2012201494 | A1 | 10/2012 |
| AU | 2012201595 | A1 | 11/2012 |

(Continued)

OTHER PUBLICATIONS

British Search Report dated Jan. 10, 2018 in corresponding British Application No. GB1713002.2 (two pages).

(Continued)

*Primary Examiner* — Chelsea E Stinson
*Assistant Examiner* — Himchan Song
(74) *Attorney, Agent, or Firm* — Kilpatrick Townsend & Stockton LLP

(57) ABSTRACT

A packaging assembly (10) including a weighing machine (11) that is located above a former (22). Located below the former (22) is a packaging machine (29), with strip bag material (25) being pulled through the assembly by a film drive assembly (46) that pulls the bag material past the former (22) to form tubular bag material (26) that is delivered to the packaging machine (29) together with product to form bags of the product.

10 Claims, 4 Drawing Sheets

(56) References Cited

U.S. PATENT DOCUMENTS

| | | | | |
|---|---|---|---|---|
| 7,152,387 | B2 | 12/2006 | Taylor | |
| 7,159,376 | B2 | 1/2007 | Taylor | |
| 7,383,672 | B2 | 6/2008 | Taylor et al. | |
| 7,415,809 | B2 | 8/2008 | Taylor | |
| 7,472,528 | B2 | 1/2009 | Taylor | |
| 7,600,630 | B2 | 10/2009 | Taylor et al. | |
| 8,656,690 | B2 * | 2/2014 | Bierschenk | B65B 1/26 53/551 |
| 2003/0050166 | A1 * | 3/2003 | Dominguez, Jr. | B65B 9/20 493/296 |
| 2005/0172582 | A1 * | 8/2005 | Taylor | B65B 31/045 53/511 |
| 2005/0183399 | A1 * | 8/2005 | Kondo | B65B 9/213 53/552 |
| 2005/0235610 | A1 | 10/2005 | Frievalt et al. | |
| 2012/0198799 | A1 * | 8/2012 | Nishitsuji | B65B 9/22 53/551 |
| 2012/0233970 | A1 * | 9/2012 | Taylor | B65B 9/22 53/545 |
| 2013/0165305 | A1 | 6/2013 | Taylor | |
| 2015/0135654 | A1 * | 5/2015 | Taylor | B65H 20/06 53/551 |
| 2016/0107774 | A1 * | 4/2016 | Kondo | B65B 39/005 53/475 |
| 2016/0114917 | A1 * | 4/2016 | Schmachtel | B65B 35/243 53/545 |
| 2018/0339460 | A1 * | 11/2018 | Anand | B65B 9/22 |

FOREIGN PATENT DOCUMENTS

| | | | | |
|---|---|---|---|---|
| AU | 2012258403 | A1 | 6/2013 | |
| AU | 2012258497 | A1 | 6/2013 | |
| AU | 2011360138 | A1 | 8/2013 | |
| AU | 2013267060 | C1 | 7/2014 | |
| AU | 2014227558 | A1 | 6/2015 | |
| AU | 2014227559 | A1 | 6/2015 | |
| AU | 2014227559 | B2 * | 2/2018 | B65B 9/2028 |
| GB | 2497414 | A | 6/2013 | |
| GB | 2497417 | A | 6/2013 | |
| GB | 2520402 | A | 5/2015 | |
| GB | 2520403 | A | 5/2015 | |
| WO | 2013/120836 | A1 | 8/2013 | |

OTHER PUBLICATIONS

Spanish Search Report dated Feb. 12, 2018 of corresponding Spanish Application No. 201731033 (six pages).

* cited by examiner

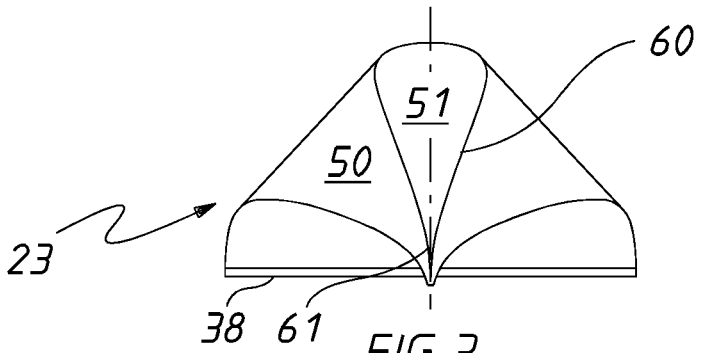
FIG.3
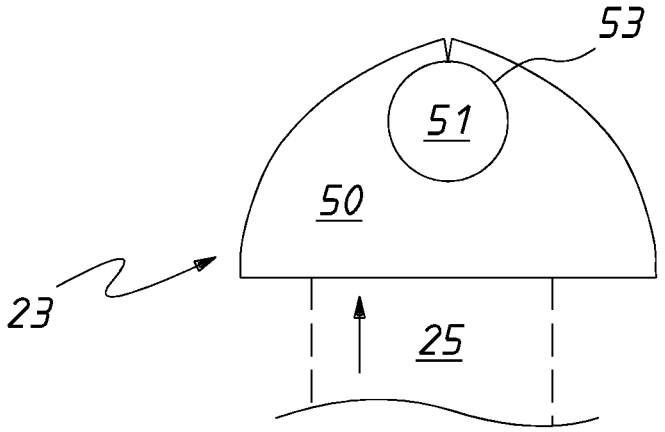
FIG.4
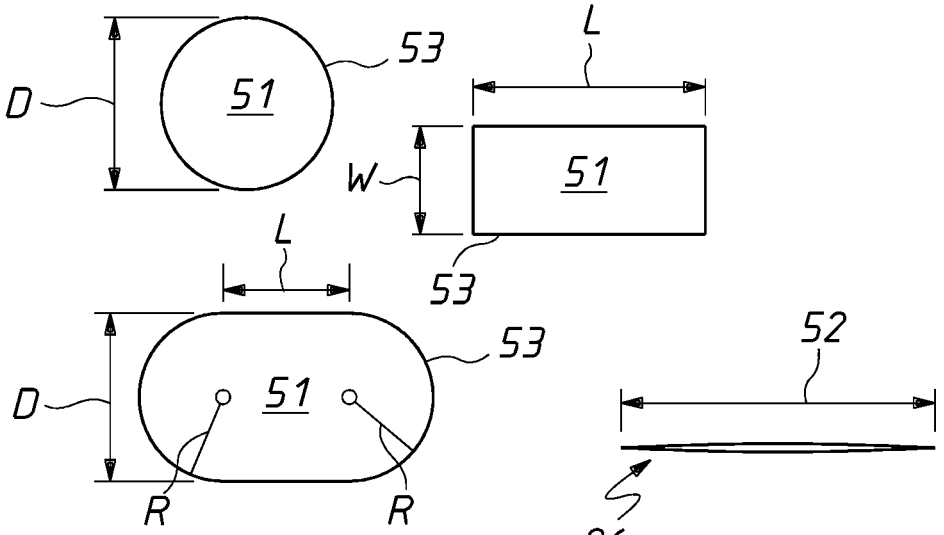
FIG.5
FIG.6

PACKAGING ASSEMBLY

FIELD

The present invention relates to packaging assemblies that produce bags of product, such as snack foods.

BACKGROUND

Packaging machines receive bag material in tubular form. Product to be packaged is delivered to the interior of the tubular bag material, with the packaging machine then transversely sealing and cutting the tubular bag material to form bags of product. The tubular bag material is formed by a former shoulder to which the packaging film is delivered in strip form. Formers and packaging machines are described in U.S. Pat. Nos. 4,910,943, 5,622,032, 4,663,917, 6,655,110, 7,159,376, 7,600,630, 7,383,672, 4,753,336, 7,124,559, 7,415,809, 7,152,387 and 7,472,528, and Australian Patent Applications 2012258403, 20122584, 2012258497, 2012201494 and 2012201595, and 2011360138, and International Application PCT/EP2013/052754.

The tubular material provided by the former shoulder is longitudinally sealed. This function is performed by heating the tubular bag material along its longitudinally overlapping edges and by applying pressure to the overlapping longitudinal edges.

Located above the former is a weighing machine that delivers batches of product to a chute that extends toward the former shoulder.

The tubular bag material passes the former shoulder, is longitudinally sealed and then delivered to the packaging machine. While this is occurring batches of product are delivered to the interior of the tubular bag material by the weigher, the batches consisting of product scattered along a length of the tubular bag material. A film drive assembly is located below the former shoulder and above the packaging machine. The film drive assembly engages the tubular bag material to cause the strip material to pass over the former, and delivers the tubular bag material to the packaging machine below. Typically the film drive assembly includes a pair of driven belts that drive the tubular bag material at a desired velocity. Rollers can also be used. The packaging machine includes at least a pair of rotatably driven jaws, with the jaws having a peripheral speed (when engaged with the tubular bag material) that matches the velocity of the tubular bag material as determined by the film drive assembly.

Product leaving the weighing machine, as mentioned above, is arranged in batches. It is not unusual for the batches to have a length of 100 ms when leaving the weighing machine. However the batches follow an arcuate path as they enter the former. This causes the product to impact against itself, and the internal surfaces of the tubular bag material. The result is that the product batches increasing in length. As an example the batch length may increase to 600 ms. To ensure the product is not located between the sealing jaws, in programming the packaging machine, it is assumed that the product batches have a length of about 650 ms.

Particularly in respect of snack foods, the batches become elongated as the product falls through the former to the packaging machine below. The greater this fall length, the greater the batch elongation.

Improvements in the above machines were described in Australian Patent Applications 201326760, 2014227558 and 2014227559.

These improvements had the aim of increasing the speed of operation of the packaging machines, to increase the number of packets produced per minute.

Over the last few decades, packaging machines, particularly snack food packaging machines, have increased in speed from approximately 80 to 100 bags per minute, to about 120 bags per minute, even 150 bags per minute.

It is a disadvantage, particularly in respect of packaging snack foods, that known packaging assemblies have their speed limited due to undesirable product batch elongation.

Object

It is the object of the present invention to overcome or substantially ameliorate the above disadvantage.

SUMMARY OF INVENTION

There is disclosed herein a packaging assembly that provides bags of product, the assembly including:

a former that receives strip bag material and forms the strip bag material into a tubular configuration by downward movement of the strip bag material past the former so as to provide tubular bag material, the former including a former shoulder that receives the strip bag material and a shoulder mounting member, the former shoulder having a lower most extremity;

a drive assembly located below the former to engage the tubular bag material to pull the tubular bag material past the former and deliver the tubular bag material downwardly;

a packaging machine below the drive assembly so as to receive the tubular bag material with the product therein, the machine including a first sealing jaw and a second sealing jaw, with the jaws engaging the tubular bag material to form the bags; and wherein the packaging machine engages the tubular bag material to close the tubular bag material at a predetermined position spaced from said lower most extremity by a distance of 100 mm to 400 mm.

Preferably, said distance is from about 150 mm to about 350 mm.

More preferably, said distance is about 200 mm to about 300 mm.

Preferably, said distance is about 250 mm to about 280 mm.

Most preferably, said distance is about 275 mm.

Preferably, the drive assembly includes a pair or rollers that are rotatably driven in rotational opposite directions, that engage the tubular bag material to move the tubular bag material past the former.

In an alternative preferred form, the drive assembly includes a pair of belts that are driven in opposite directions, and that engage the tubular bag material to move the tubular bag material past the former.

Preferably, the packaging machine is a rotary packaging machine, with the jaws being rotatably driven through repeated revolutions in opposite rotational directions about spaced generally parallel axes.

Preferably, the former shoulder has an aperture through which the bag material passes and through which the product passes to be located internally of the tubular bag material, with the aperture when viewed in plan having a periphery of 100 mm to 840 mm.

Preferably, said periphery is 200 mm to 360 mm.

There is also disclosed herein a packaging assembly that provides bags of product, the assembly including:

a former that receives strip bag material and forms the strip bag material into a tubular configuration by downward movement of the strip bag material past the former so as to provide tubular bag material, the former including a former shoulder that receives the strip bag material and a shoulder mounting member, the former shoulder having a rim surrounding an opening through which the bag material and product passes, the rim having a cross-over location where portions of the rim are adjacent and cross;

a drive assembly located below the former to engage the tubular bag material to pull the tubular bag material past the former and deliver the tubular bag material downwardly;

a packaging machine below the drive assembly so as to receive the tubular bag material with the product therein, the machine including a first sealing jaw and a second sealing jaw, with the jaws engaging the tubular bag material to form the bags; and wherein the packaging machine engages the tubular bag material to close the tubular bag material at a predetermined position spaced from said cross-over location by a distance of 100 mm to 400 mm.

Preferably, said distance is 100 mm to 350 mm.

Preferably, said distance is 200 mm to 350 mm.

Preferably, the drive assembly includes a pair or rollers that are rotatably driven in rotational opposite directions, that engage the tubular bag material to move the tubular bag material past the former.

Preferably, the drive assembly includes a pair of belts that are driven in opposite directions, and that engage the tubular bag material to move the tubular bag material past the former.

Preferably, the packaging machine is a rotary packaging machine, with the jaws being rotatably driven through repeated revolutions in opposite rotational directions about spaced generally parallel axes.

Preferably, the former shoulder has an aperture through which the bag material passes and through which the product passes to be located internally of the tubular bag material, with the aperture when viewed in plan having a periphery of 100 mm to 840 mm.

Preferably, said periphery is 200 mm to 360 mm.

Preferably, said former provides a flat bag width of 50 mm to 420 mm.

Preferably, said former provides a flat bag width of 50 mm to 420 mm.

More preferably, said former provides a flat bag width of 100 mm to 180 mm.

BRIEF DESCRIPTION OF DRAWINGS

Preferred forms of the present invention will now be described by way of example with reference to the accompanying drawings wherein:

FIG. 3 is a schematic side elevation of a former shoulder of the packaging assembly of FIG. 1;

FIG. 4 is a schematic top plan view of the former shoulder of FIG. 3;

FIG. 5 is a series of schematic plan views of central apertures of the former shoulder of FIGS. 3 and 4;

FIG. 6 is a schematic view of a "Flat Bag Width"; and

DESCRIPTION OF EMBODIMENTS

Figure 1:
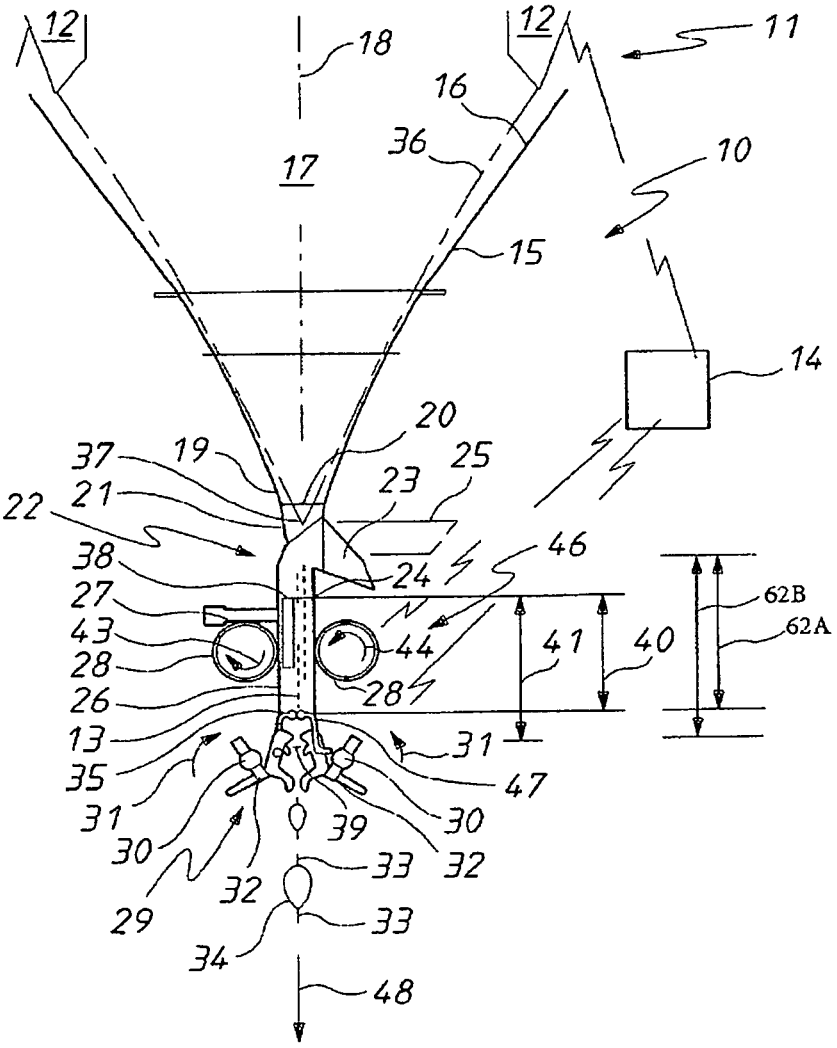
FIG. 1 is a schematic side elevation of a packaging assembly.

In the accompanying drawings there is schematically depicted a packaging assembly 10. The assembly 10 includes a weighing machine (scales) 11. The weighing machine 11 has a plurality of buckets 12 that receive product from a central cone (not illustrated). Product 13 is delivered to the buckets 12, with each bucket 12 providing an indication of the weight of the product contained therein. A central computer 14 operates the weighing machine 11 so that one or more the buckets 12 are opened so that a batch of product 13 is delivered to a chute 15, with each batch of product corresponding to a batch that is to be contained in a bag 34 to be formed.

The chute 15 has an internal surface that converges downwardly, with the product 13 sliding along the surface 16 in its downward passage. The surface 16 surrounds a cavity to which the product 13 is delivered.

The buckets 12 are located so that the product 13 is delivered to the surface 16 so that the product 13 slides therealong.

In this embodiment the chute 15 is circular in transverse horizontal cross-section.

The chute 15 has a generally upright central longitudinal axis 18, with the surface 16 converging towards the axis 18 to a lower end extremity 19 of the chute 15 so as to provide a product exit opening 20 for the chute 15.

Located below the chute 15 is a sleeve 21, while below the sleeve 21 is a former 22. The former 22 includes a former shoulder 23 and a former base (mounting member) 24. Usually the base 24 is a plate. The shoulder 23 has a lower most extremity 38 that corresponds to the position of the upper surface of the base 24.

The former shoulder 23 receives strip bag material 25 and forms the bag material 25 into tubular bag material 26.

Product delivered to the opening 20 passes down through the sleeve 21 and is delivered to the internal cavity of the shoulder 23. Accordingly, the product 13 is delivered to the interior of the tubular bag material 26.

Figure 7:
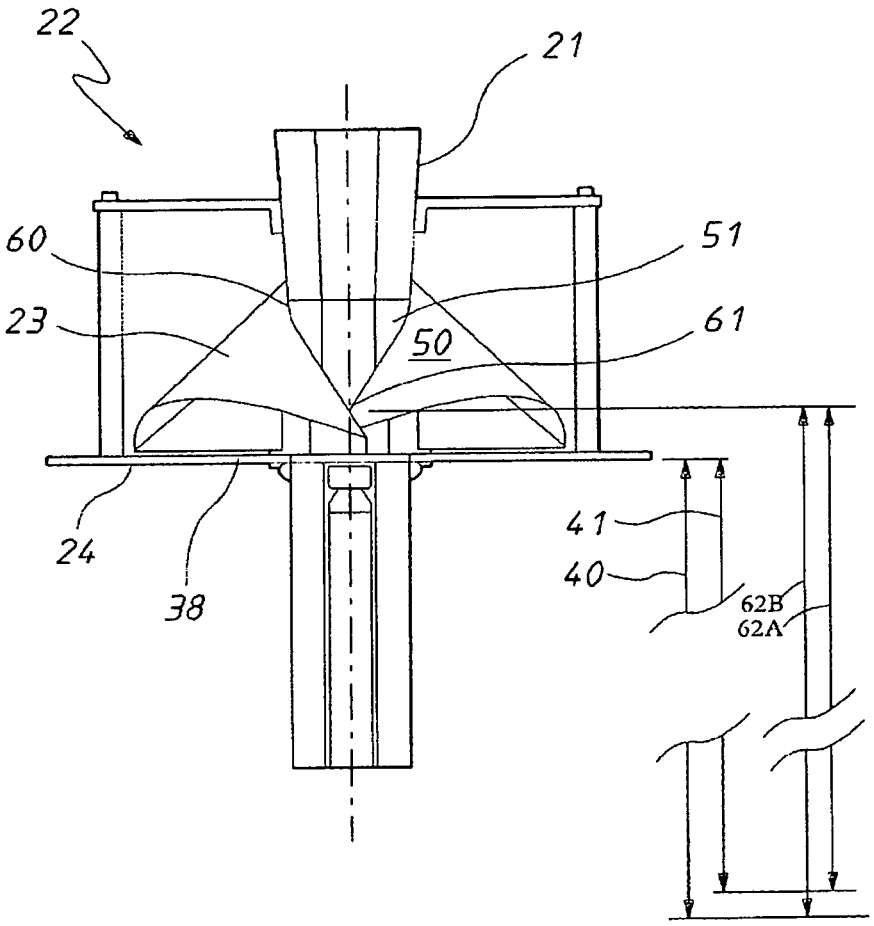
FIG. 7 is a schematic front elevation of the former of FIG. 1.

In FIGS. 3, 4 and 7 there is schematically depicted the former shoulder 23. The former shoulder 23 has an external surface 50 that engages the strip of bag material 25 to configure it into tubular bag material 26. In the embodiment of FIGS. 3 and 4, the former shoulder 23 has an aperture 51 through which the bag material 25 passes, and through which the product being packaged also passes to enter the tubular bag material 26. When viewed in plan the aperture 51 of the embodiment of FIGS. 3 and 4 is circular. However, the former shoulder 23 could provide apertures of other configuration, as shown in FIG. 5 (square, rectangular, oval). When viewed in plan, the view is in the direction of the axis 18. The upper rim 60 over which the bag material passes surrounds the aperture 51.

In side elevation the rim 60 crosses at a cross-over location 61.

A sealing bar 27 engages the overlapping longitudinal edges of the tubular bag material 26 to sealingly connect the longitudinal edges of the bag material 26. Preferably, the bar 27 would seal the edges ultrasonically.

The tubular bag material 26 is engaged by a drive assembly 46, that in this embodiment include drive rollers 28 that are rotatably driven through repeated revolutions in opposite rotational directions 43 and 44 so as to pull the tubular bag material 26 downward in the direction 48, while also pulling the strip bag material 25 over the shoulder 23. In this embodiment the drive rollers 28 would have a vacuum delivered to them, and have peripheral apertures so that air pressure pushes the tubular bag material 26 against the rollers 28 to provide for good frictional engagement between the rollers 28 and the tubular bag material 26. The assembly 46 is located below the former 23.

Located below the rollers 28, and therefore the former 22, is a packaging machine 29. The packaging machine 29 may be a vertically reciprocating packaging machine, or a rotatory packaging machine. In this embodiment the packaging machine 29 is a rotary packaging machine. The rotary packaging machine 29 includes a pair of drive shafts 30 that are rotatably driven in synchronism through repeated revolutions in opposite angular direction 31. Fixed to the shafts 30 are sealing jaws 32. In this embodiment each shaft 32 has a pair of sealing jaws 32, the jaws 32 of each shaft 30 being spaced by 180°. Each shaft 30 rotates about a generally horizontal central axis, with the axes being generally parallel and transversely spaced.

Rotation of the shafts 30 causes the jaws 32 to engage the tubular bag material 26, to form transverse seals in bags 34 being formed. Preferably the sealing jaws 32 also include a blade that severs adjacent bags from each other, by cutting along the end seals 33.

In this embodiment the packaging machine 20 has closer bars 35. The construction of the packaging machine 29 is best understood with reference to U.S. Pat. No. 4,663,917. However it should be appreciated the machine 20 may not have the bars 35.

The jaws 32 and bars 35 provide a mechanism that engages and closes the tubular bag material 26. Where closer bars 35 are employed, it is the closer bars 35 that first close the tubular bag material and do so at the location 47, that is a predetermined position at which the bars 35 first close the tubular bag material 26. Where bars 35 are not employed, the jaws 32 engage and close the tubular bag material at a predetermined position, that is the location 39. This is the location at which the tubular bag material 26 is first closed.

When the jaws 32 are engaged, is a sliding action so that the tubular bag material 26 is located therebetween, the tubular bag material 26 is squashed as shown in FIG. 6. When squashed, the tubular bag material 26 has a width 52, a "Flat Bag Width" (FBW). With reference to FIG. 5, when the aperture 51 is circular the flat bag width is $\pi \times D/_2$ (diameter), when the aperture 51 is oval, the flat bag width is L (Length)+$\pi D/_2$, while if the aperture is square the flat bag width is 2 L, while if the aperture 51 is rectangular, the flat bag width is L+W. The peripheral 53 (provided by the rim 60) of the aperture 51 is twice the FBW. The former 22 will have a specified FBW, or in other words the former 22 will be configured for a specific bag size.

The computer 14 controls operation of the weighing machine 11, the rollers 28, and the packaging machine 29, so that batches of product delivered from the chute 15 arrive at the correct time relative to rotation of the sealing jaws 32.

The product 13 delivered to the chute 15 by the buckets 12 follows a parabolic path 36 defined by the surface 16. That is each product batch falls along a path 36.

The paths 36, that is each path 36 extending from each bucket 12, converge downwardly. However, as the product 13 travels along the paths 36, towards the lower end extremity 19, the product leaves the surface 16 and follows a trajectory space from the surface 16. The trajectories of the paths 16 intersect at an apex 37. At the apex 37 the product 13 impacts against itself.

It has been found that by particularly locating the former 22, assembly 46 and packaging machine 29, batch elongation can be minimized and therefore speed of the machine 29 optimised. In particular, upon realising that the product impacts at the location 37, it has been found that by particularly arranging the distances 40 and 41, batch elongation can be minimized, therefore enabling the machine 29 to be optimised in respect of speed of operation. Preferably the distances 40 and 41 are from about 100 mm to about 400 mm. More preferably from about 200 mm to 300 mm, more preferably 250 mm to 280 mm, and most preferably 275 mm. As seen in FIG. 1, the distance 41 is the distance between the location 39 and the lower most extremity 38, while the distance 40 is the distance between the location 47 and the extremity 38.

The location 61 is spaced from the locations 35 by the distance 62A, and the location 61 is spaced from the location 39 by the distance 62, the distances 62A and 62B are from 100 mm to 400 mm, preferably 100 mm to 350 mm, and most preferably 200 mm to 350 mm, for a FBW of 50 mm to 420 mm, and most preferably a FBW of 100 mm to 180 mm.

In the above described preferred embodiment the axes of the shafts 30 are substantially horizontal, that is they do not move vertically. In some instances the shafts 30 can move laterally slightly to accommodate engagement of the jaws 32 with the packaging material.

In further embodiments, the shafts 30 oscillate vertically by up to about 100 mm, most preferably about 50 mm. In this embodiment, the distances 40 and 41 are relative to the upper limits of travel of the shafts 30.

Figure 2:
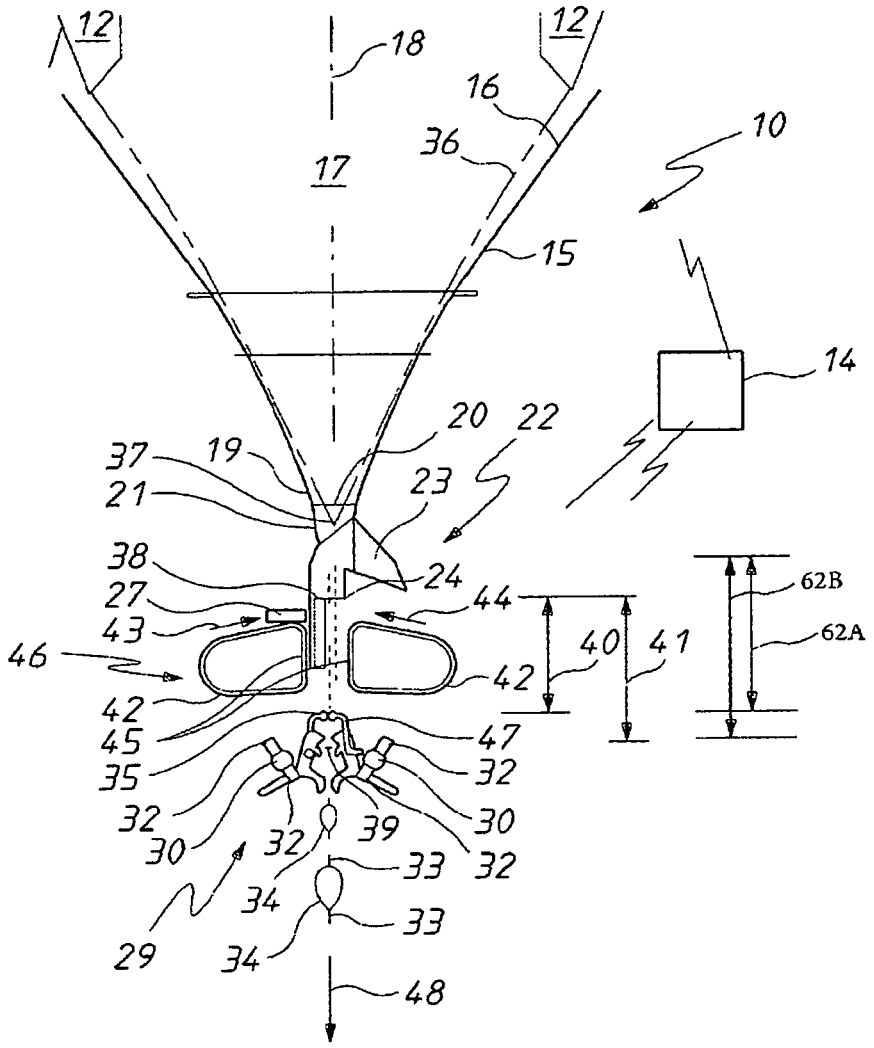
FIG. 2 is a schematic side elevation of a modification of the packaging assembly of FIG. 1.

In the embodiment of FIG. 2, the rollers 28 are replaced with drive belts 42 that provide the assembly 46. The belts are driven in opposite directions 43 and 44 so that the belt lengths 45 move with the tubular bag material 26. Preferably, the belts 42 are provided with apertures, with manifolds communicating with the apertures along the lengths 45 so that there is reduced air pressure applied to the belts 42, drawing the tubular bag material 26 into firm frictional engagement with the belts 42.

The former 22 will have a FBW of 50 mm to 420 mm and most likely 100 mm to 180 mm. That is, the aperture 51 will have a periphery of 100 mm to 840 mm, most probably 200 mm to 360 mm.

By having the distances 40, 41 62A and 62B as described above, for the above FBW, batch elongation is minimised, thereby allowing the speed of operation of the packaging machine 29 to be maximised. The machine 29, with the distances 40 and 41, can operate to produce about 250 to 300 bags per minute with some snack foods. This is considerably greater than previous machines. A further advantage is that rejects (incorrectly formed bags) are reduced, as the chance of product being located in the bag seals is reduced.

The invention claimed is:

1. A packaging assembly that provides bags of product, the assembly comprising:

a former configured to receive strip bag material and form the strip bag material into a tubular configuration by downward movement of the strip bag material past the former so as to provide tubular bag material, the former comprising a former shoulder configured to receive the strip bag material and a shoulder mounting member, the former shoulder defining a rim surrounding an opening through which the bag material and product pass, the rim having a cross-over location where portions of the rim are adjacent and cross;

a drive assembly located below the former configured to engage the tubular bag material to pull the tubular bag material past the former and deliver the tubular bag material downwardly; and a packaging machine below the drive assembly configured to receive the tubular bag material with the product therein, the machine including a first sealing jaw and a second sealing jaw, with the jaws engaging the tubular bag material to form the bags;

wherein the packaging machine is configured to engage the tubular bag material to close the tubular bag material at a predetermined position spaced from said cross-over location by a distance of 100 mm to 400 mm; and wherein the former is configured to provide a flat bag width of 50 mm to 420 mm.

2. The packaging assembly of claim 1, wherein said distance is 100 mm to 350 mm.

3. The packaging assembly of claim 1, wherein said distance is 200 mm to 350 mm.

4. The packaging assembly of claim 1 wherein the drive assembly includes a pair of rollers that are rotatably driven in rotational opposite directions, that engage the tubular bag material to move the tubular bag material past the former.

5. The packaging assembly of claim 1, wherein the drive assembly includes a pair of belts that are driven in opposite directions, and that engage the tubular bag material to move the tubular bag material past the former.

6. The packaging assembly of claim 1, wherein the packaging machine is a rotary packaging machine, with the jaws being rotatably driven through repeated revolutions in opposite rotational directions about spaced generally parallel axes.

7. The packaging assembly of claim 1, wherein the former shoulder defines an aperture through which the bag material passes and through which the product passes to be located internally of the tubular bag material, with the aperture having a periphery of 100 mm to 840 mm.

8. The packaging assembly claim 7, wherein said periphery is 200 mm to 360 mm.

9. The packaging assembly of claim 1, wherein said distance is 200 mm to 300 mm wherein the former provides a flat bag width of 50 mm to 420 mm.

10. The packaging assembly of claim 1, wherein the former provides the flat bag width of 100 mm to 180 mm.

* * * * *